US009353735B2

(12) United States Patent
Gerbron et al.

(10) Patent No.: US 9,353,735 B2
(45) Date of Patent: May 31, 2016

(54) PUMP FOR METERING AND DISPENSING A LIQUID OR VISCOUS PRODUCT

(76) Inventors: Jacques Gerbron, Menton (FR); Patrick Lagneaux, Aubry du Hainaut (FR); Jian Jun Yuan, Zhejiang (CN)

( * ) Notice: Subject to any disclaimer, the term of this patent is extended or adjusted under 35 U.S.C. 154(b) by 232 days.

(21) Appl. No.: 14/117,285

(22) PCT Filed: May 11, 2012

(86) PCT No.: PCT/EP2012/058717

§ 371 (c)(1),
(2), (4) Date: Aug. 4, 2014

(87) PCT Pub. No.: WO2012/152901

PCT Pub. Date: Nov. 15, 2012

(65) Prior Publication Data

US 2015/0139834 A1 May 21, 2015

(30) Foreign Application Priority Data

May 11, 2011 (FR) ..... 11 54045

(51) Int. Cl.

| | |
|---|---|
| ***F04B 7/02*** | (2006.01) |
| ***F04B 15/02*** | (2006.01) |
| *B05B 11/00* | (2006.01) |

(52) U.S. Cl.

CPC ..... *F04B 15/02* (2013.01); *B05B 11/0067* (2013.01); *B05B 11/0072* (2013.01); *B05B 11/3073* (2013.01); *F04B 7/02* (2013.01); *B05B 11/007* (2013.01); *B05B 11/3001* (2013.01); *B05B 11/307* (2013.01); *B05B 11/3016* (2013.01); *B05B 11/3074* (2013.01)

(58) Field of Classification Search

CPC ..... F04B 7/02; F04B 15/02; B05B 11/0067; B05B 11/007; B05B 11/307; B05B 11/3074; B05B 11/3001; B05B 11/3016; B05B 11/0072; B05B 11/3073

See application file for complete search history.

(56) References Cited

U.S. PATENT DOCUMENTS

| | | | | |
|---|---|---|---|---|
| 4,830,284 | A * | 5/1989 | Maerte | 239/333 |
| 5,195,665 | A * | 3/1993 | Lina | 222/496 |
| 5,842,616 | A * | 12/1998 | Ruscitti et al. | 222/321.3 |
| 5,988,449 | A * | 11/1999 | Fuchs et al. | 222/189.11 |
| 6,161,732 | A * | 12/2000 | Albini | 222/321.3 |
| 8,985,401 | B2 * | 3/2015 | Welp | 222/321.8 |
| 2004/0026457 | A1 * | 2/2004 | Petit | 222/321.2 |
| 2009/0236445 | A1 | 9/2009 | Lintern et al. | |

FOREIGN PATENT DOCUMENTS

| | | |
|---|---|---|
| DE | 102005043258 | 3/2006 |
| DE | 102008027598 | 12/2009 |

OTHER PUBLICATIONS

PCT/ISA/237 Written Opinion issued on PCT/EP2012/058717 pp. 7, Date: Jul. 12, 2012.

* cited by examiner

*Primary Examiner* — Frederick C Nicolas
(74) *Attorney, Agent, or Firm* — The Farrell Law Firm, P.C.

(57) ABSTRACT

Provided is a device for metering and dispensing a liquid or viscous product. The device includes an inlet opening at a lower longitudinal end for the passage of the product from a container, an outlet opening at an upper longitudinal end for the dispensing of the product from the device, and a main chamber accommodating a piston that moves lengthwise with respect to the main chamber.

26 Claims, 5 Drawing Sheets

PUMP FOR METERING AND DISPENSING A LIQUID OR VISCOUS PRODUCT

PRIORITY

This application is a U.S. National Phase application of International Application No. PCT/EP2012/058717 filed May 11, 2012, claiming priority to Application No. 1154045 filed with the European Property Office on May 11, 2011, the content of each of which is incorporated herein by reference.

The present invention relates to a pump for metering and dispensing a liquid or viscous product, with such pump being intended to be associated with a dispensing element forming part of a container containing said product.

These metering pumps are already known in the state of the art.

For example, the document U.S. Pat. No. 4,830,284 discloses a pump for metering and dispensing a product, especially a liquid or a pasty substance, the product being contained in a container on which the pump is fixed, for example by screwing on a threaded portion carried by a member of the container.

The metering pump described herein comprises a chamber inside, so-called a pressure chamber, with such chamber having an opening for letting the product from the container in and thus receiving the product prior to the dispensing thereof to the outside.

The chamber accommodates a piston which can move inside said chamber, said piston being returned by a spring to a so-called rest position. This chamber also communicates with a discharge chamber through an intermediate opening.

The discharge chamber communicates with the outside of the metering pump through a product draining opening. The draining opening is closed in the piston rest position by a closure valve. The volume of the chamber is variable and its increase causes the opening of the closure valve.

The metering pump according to this document operates as follows. When actuating an actuating means dispensing the product to the outside, some product to be dispensed is introduced into the pressure chamber through the inlet opening of the chamber with the container. The piston is then moved from its rest position and no longer locks the intermediate opening between the pressure chamber and the discharge chamber.

The product can then flow into the discharge chamber that it fills. Due to the fluid pressure in the discharge chamber, the volume of the discharge chamber is increased and the closure valve no longer closes the draining opening of the metering pump. The product can then flow out of said pump. The pressure drop in the discharge chamber, due to the draining of a portion of the product out of the pump, then repositions the closure valve in the position closing the draining opening of the metering pump.

The result is a pressure drop in the product inside the metering pump and the return spring repositions the piston in the position closing the intermediate opening and the draining opening.

The metering pump according to this prior art has several notable drawbacks.

The first drawback is that the return spring is located inside the pressure chamber. It is thus in contact with the product to be dispensed, which can both pollute the product to be dispensed and damage the return spring, for example through the corrosion of said spring by the product if the latter is an acid or basic substance or through the clogging of the spring by the product if the latter is viscous or pasty.

The second drawback is that the communication between the pressure chamber and the discharge chamber involves a high number of elements. As a matter of fact, in this document, a first resilient sleeve is provided for the piston head in the first chamber cooperating with a sealing shoulder and a second elastic sleeve for the piston head in the discharge chamber. Such communication should be simplified by not implying so many elements.

The publication DE 10 2008 027 598-A1 shows a fluid dispenser the head of which includes a fluid outlet opening. A return spring is accommodated to return a piston moved during the dispensing in position. One drawback consists in that a leak test of such an assembly is in practice difficult or even impossible, so that wastes are detected late. Another disadvantage is the complexity of the system.

The problem underlying the present invention is to solve all or part of the disadvantages of the existing techniques.

To reach this aim, the invention provides for a pump for metering and dispensing a liquid or viscous product intended to be associated with a container containing said product, with said pump having, at one so-called lower longitudinal end, an inlet opening for the passage of the product from the container and at a so-called upper longitudinal end, an outlet opening for the dispensing of the product from the pump, with said pump having inside a main chamber accommodating a piston having a body and a head, with said piston being movable lengthwise with respect to the main chamber,

- said body having an inner pipe extending lengthwise there through and connected to the inlet opening at its lower part for the product to flow from said opening inlet,
- said body and the lower part of said piston head occupying the main chamber leaving only a separation chamber empty, positioned about the piston body,
- with said piston head totally separating the separation chamber from a discharge chamber positioned near the outlet opening, with the upper part of said head having in the upper middle portion thereof a means for closing said outlet opening, the inner pipe at its upper end indirectly leading into the discharge chamber for the product to flow into said chamber, said discharge chamber having a variable volume according to the piston motion within the main chamber,
- return means being provided to act on the piston by placing the closing means in the position closing said outlet opening, characterized in that the separation chamber is sealed with respect to the product flow since it is not passed through by the latter. According to one possible solution, said return means are accommodated in the separation chamber.

A technical effect thus obtained is a protection of the return means accommodated in a sealed chamber for the product to be dispensed against potential damage by said product, for example through the clogging or a corrosion of such means due to a build-up of product on these means or an extended contact of such means with the product. This allows a safer operation of the pump assembly and a longer life of the various components of this pump.

Advantageously, the peripheral wall of the pump has an orifice which is used as an outlet for the checking of possible leakages. As a matter of fact, this type of pump is typically difficult to control and the orifice solves this problem, as described below.

According to another possibility, the container has a conveniently collapsible fluid reservoir, and an outer shell deformable by pressing the shell exerting a pressure on the outside of the tank and initiating the product flow to the pump.

In a preferred embodiment, the sealed chamber is also intended to be used during phases of device sealing test. Indeed, when injecting a test gas (such as air) into the chamber, leakages can be detected at the joint between the piston and the parts around the latter, among which the needle and the areas in contact with the piston on its periphery.

In particular, the invention may comprise a hole, accessible from the outside, in order to cooperate with means for injecting a test fluid through the hole or with leaks detection means (a pressure sensor for example) during the injection of fluids into other parts of the device).

Optionally, the invention further includes at least any one of the following features:

the sealing means is the upper end of a needle extending between the upper end of the inner pipe and the outlet opening of the pump.

the needle has a rod and an upper end having a rounded or an acute shape.

a portion of the rod is surrounded by an inner flange, with the remaining portion of the rod and the rounded-or acute shaped upper end of the needle projecting upwards from said inner flange, with said inner flange being surrounded by an outer flange while leaving a space there between, the needle and said flanges forming the to piston head.

the space between said flanges decreases towards the body of the piston.

the needle has a passage for the product from the inner pipe while being connected at its lower part to said inner pipe and at least one filling opening leading into the discharge chamber for said product to flow into the discharge chamber.

the passage is provided by a longitudinal groove extending from the lower part of the needle opposite the inner pipe and in sealing communication with said pipe, with at least a portion of the groove forming a slot on the periphery of the needle, with such slot being used as a filling opening.

the longitudinal groove extends over the entire width of the needle, with two portions of the groove each forming a slot on the periphery of the needle, with said slots being oppositely positioned on said periphery.

the return means are at least partly accommodated in the separation chamber.

the return means comprise a helical spring or at least a flexible blade surrounding the body of the piston on at least part of the length thereof.

the return means comprise an element made of an elastically deformable material, preferably an elastomer.

the element made of elastically deformable material is a hollow cylindrical body surrounding the body of the piston.

the return means are integrally accommodated in the separation chamber.

the return means comprise at least one flexible wall formed on the body.

at least one flexible wall is a portion of the body having a tapered shape.

the at least one flexible wall is connected to the body by hinged areas.

the hinged areas have a relatively reduced thickness as compared with that of the flexible wall, it comprises a plurality of flexible walls, at least two flexible walls are so configured as to form bellows, the body and the head are two separate fit parts the outlet opening of the pump is in line with its inlet opening or forms an angle of approximately 90° therewith, the body of the piston comprises a base toward its opposite free end opposite the head, with the base cooperating with a liner guide through a tight slide fit.

the base has an outer profile which widens towards the free end of the body, the outer profile is domed so as to be convex.

the base has an inner profile which widens towards the free end of the body, the thickness of the base decreases towards the free end of the body, the inner profile is domed so as to be concave, the main chamber is at least partially delimited by a peripheral wall having at least one orifice leading, on the one hand, into the main chamber and on the other hand, to the outside of the pump.

The invention also relates to a detachable cap intended to be associated with a container containing a liquid or viscous product, characterized in that it integrates such a metering and dispensing pump.

The invention eventually relates to a container containing a liquid or viscous product provided with an element for dispensing said product, characterized in that it comprises such a metering and dispensing pump or such detachable cap, the pump or the cap being made integral with said dispensing element.

Advantageously, the reservoir of the container is made of a flexible material, with the pump being supplied with product through one or more manual pressures exerted on said reservoir and initiating the flow of product to the pump.

According to another possibility, the container has a conveniently collapsible reservoir and a bulb remotely connected to said reservoir through a pipe, with one or more pressure(s) being exerted on said bulb being transmitted outside the tank and initiating the flow of product to the pump.

Advantageously, the product is dispensed out of the container by spraying, projection or flow.

A method for testing the pump is another aspect of the invention, the method comprising the steps of:

using a pump, letting a test fluid into the main chamber through the orifice, detecting a level of loss-of-vacuum in the main chamber by means of the test fluid.

The test method may also be such that it comprises the steps of:

using a pump, letting a test fluid in, through the inlet opening or the outlet opening, detecting a leakage of the test fluid at the orifice.

Other characteristics, aims and advantages of the present invention will appear upon reading the following detailed description and referring to the appended drawings given as non-restrictive examples and wherein:

FIG. 1 is a schematic representation of a longitudinal section of a dispensing element of a container provided with a metering and dispensing pump according to the present invention, FIG. 2 is a schematic representation of a perspective view of a piston longitudinally cut in half with a needle belonging to an embodiment of the metering and dispensing pump according to the present invention, FIG. 3 is a schematic representation of a perspective view of a piston with a needle belonging to the same embodiment of the metering and dispensing pump according to the present invention as that of FIG. 2, FIG. 4 is a schematic representation of a sectional view along the A-A axis shown in FIG. 3 of a piston with a needle belonging to the same embodiment of the metering and dispensing pump according to the present invention as that of FIG. 2, transversally to the openings provided in the needle, FIG. 5 is a schematic representation of a sectional view along the B-B axis shown in FIG. 4 of a piston with a needle belonging to the same embodiment of the metering and dispensing pump according to the present invention as that of FIG. 2, FIG. 6 is a schematic representation of a longitudinal section of a dispensing element of a container according to another embodiment than FIG. 1, with said container being provided with a metering and dispensing pump according to the present invention, FIG. 7 shows an alternative embodiment of the invention.

The present invention relates to a pump 1 for metering and dispensing a liquid or viscous product, with such pump being intended to be associated with a dispensing element 3 forming part of a container 2 containing said product. Dispensing means any form of product application, for example spraying, projection or flow.

Figure 1:
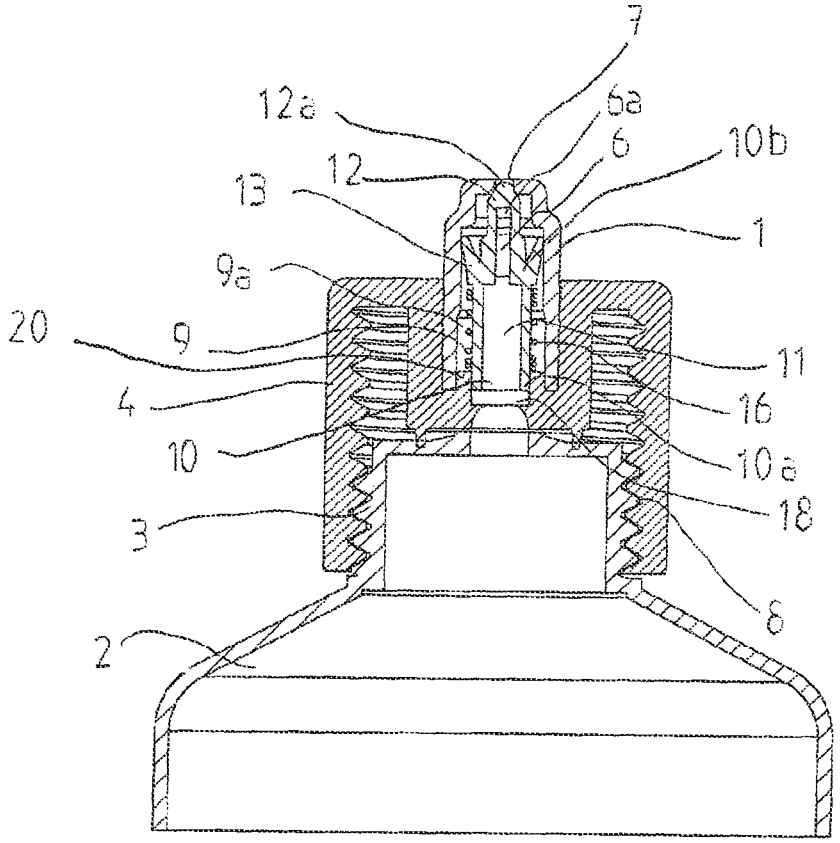

Advantageously, the metering and dispensing pump 1 is integrally formed in a detachable cap 4 on any type of containers 2, mainly flexible tubes. In FIG. 1, the cap 4 is screwed by a thread 8 onto a dispensing element 3 which covers said container 2.

In the following, the container 2 will be described with the metering and dispensing pump 1 positioned in the upper part thereof. This position is the conventional operating position of the pump 1, but the latter may operate when its longitudinal axis is inclined relative to the vertical. For a given element of the pump 1, top and bottom will respectively refer to what is opposite or facing the container 2. This will be the same for the upper and lower portions, the upper portions being closer to the outlet opening of the pump than the lower portions and reversely as regards the proximity thereof to the container 2.

The metering pump 1 receives the product from the container 2 through an inlet opening 18 and dispenses the product to the outside of the pump through an outlet opening 7. This outlet opening 7, in the two embodiments shown in FIGS. 1 and 6, forms the dispensing opening of the container 2.

Inside the metering and dispensing pump 1 is a first chamber, called the main chamber 9. The main chamber 9 receives a piston 10. The piston 10 is hollow inside in that it has an inner pipe 11 used for the passage of the liquid or viscous product to be metered and dispensed. The inner pipe 11 at least partially goes through the piston 10 lengthwise. This inner pipe 11 may also be called a compression chamber of the product to be dispensed and may also have a reservoir-shaped element which can thus be used as a reservoir of product to be dispensed, but it is not compulsory.

The piston 10 has a body 10*a* extending lengthwise of the primary chamber 9 and a head 10*b* at the end thereof which is furthest from the container 2.

The body 10*a* of the piston 10 includes inside the inner pipe 11 and tightly defines the inner pipe 11 of the main chamber 9, by not allowing the product to go into the remaining part of the main chamber 9 not occupied by the piston. The remaining part of the main chamber 9, bearing reference number 9*a* in FIG. 1 and positioned between the body 10*a* of the piston 10 and the lower portion of the piston head 10*b* of the piston 10 will hereinafter be called a separation chamber.

In the separation chamber 9*a* which is sealed are accommodated, in one embodiment, return means 16 of the piston 10, the latter returning the piston to a position wherein the head 10*b* thereof is in the furthest position from the container 2, this position being called the upper position, this in view of the closing of the draining opening 7 of the pump 1, as will be described later. Such return means 16 advantageously comprise a return spring 16 at least partially surrounding the body 10*a* of the piston, which spring is advantageously a helical spring wound around the body 10*a*. These may also be other flexible elements, such as at least one flexible blade, for example made of plastic material.

The piston body 10*a*, through which the inner pipe 11 is laid lengthwise, cooperates at its lower end, i.e. the end which is closest to the container 2, directly with the opening inlet 18 of the pump 1 for the product to flow into said pump 1 from the dispensing element 3 of the container 2, so that any product leaving the dispensing element 3 directly flows through the inner pipe 11 of the piston 10.

At the inlet opening 18, the end of the body 10*a* is advantageously guided in translation by a surface used as a guide liner 20 for the base 21 of the piston 10*a*. The guide liner is preferably cylindrical and may be formed in the cap 4, advantageously integrally therewith. In the particular embodiment illustrated in FIG. 1, a cylinder/cylinder contact is produced between the guide liner 20 and the base 21 of the piston and provides a seal at the inlet opening 18.

Figure 6:
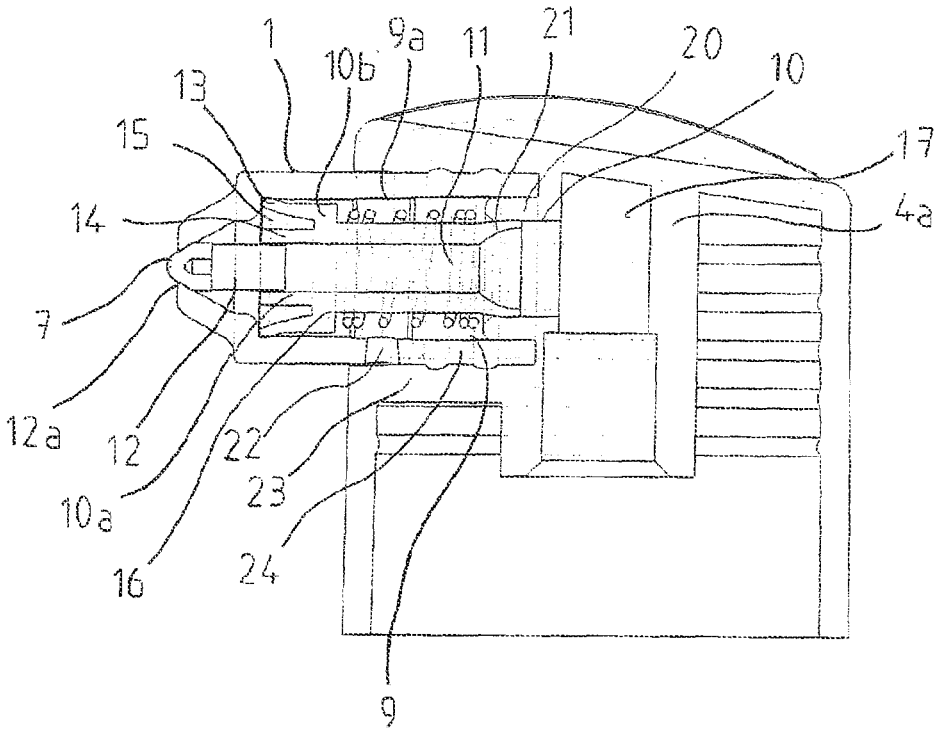

In the alternative solution shown in FIG. 6, the base 21 has a flared profile which widens towards the end of the body 10*a* of the piston 10. Preferably, this flared profile is curvilinear so as to form a dome on the inner and/or outer face.

Moreover, the flared shape preferably has a reduction in thickness towards the end of the body 10*a* so as to increase the deformability thereof in this area.

The flared shape makes it possible to limit frictions between the liner 20 and the base 21 by reducing the contact surface. In the case of a progressive section, the product naturally tends to flow through the inner pipe 11.

In the case of an internal flared profile, attainable in addition or alternatively to the outer flared profile, it allows radially orienting a part of the pressure exerted by the product to be dispensed so that, within a predetermined range of product pressure, the load of the base 21 on the liner 20 is increased thus increasing the sealing.

The upper part of the head 10*b* of the piston 10 defines a limit between the separation chamber 9*a* and a third chamber, hereinafter called the discharge chamber 5. The head 10*b* is so arranged as to have the inner pipe 11 under its lower part and the discharge chamber 5 over a large part of its upper surface with the exception of the median portion of this upper surface forming a support 12*a* carrying the closing means pointing to the outlet opening 7 of the pump 1. This discharge chamber 5 has a variable volume as will be seen later, as will be detailed the characteristics of the closing means 12*a* and its support.

FIGS. 2-5 show sectional and/or perspective enlargements of the piston 10 shown in FIG. 1 which give a better view of the various elements forming the piston 10.

In these figures, the closing means 12*a* carried by the piston head 10*b*, i.e. its upper end opposite the container, is composed of the upper end or distal end of a needle 12 extending lengthwise to the piston 10, starting from the lower face of the piston head 10*b* and projecting from the upper face of said head 10*b* facing towards the outlet opening of the pump. The needle 12 thus forms the closing means 12*a* and its support.

This needle 12 is thus formed of an upper end 12*a*, used as means for closing the outlet opening 12*b* and a rod at least partially received in the piston 10, in FIGS. 2-5 its lower part and a portion of the middle portion thereof. The upper end 12*a* of the needle 12 may have a rounded or acute shape. A rounded or acute shape ensures a better sealing between the upper end 12*a* of the needle 12 and the outlet opening for the flow of the product out of the pump. The rod 12*b* of the needle 12 may be cylindrical in shape.

Figure 2:
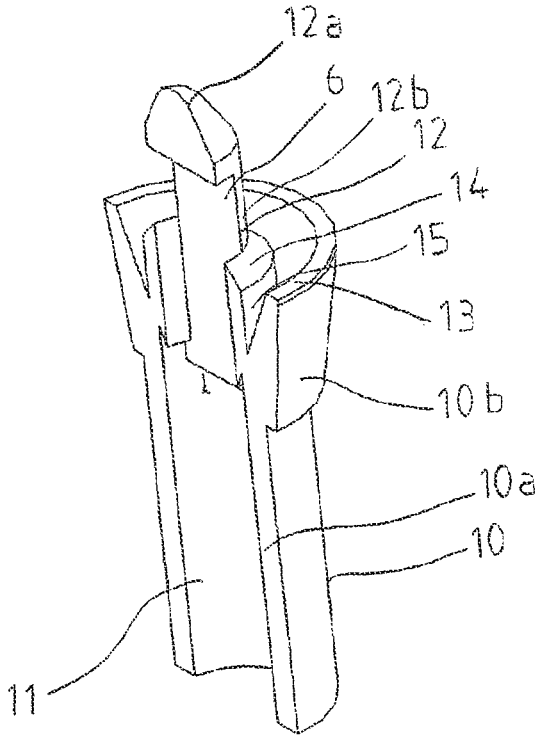

As is particularly visible in FIG. 2, which shows a longitudinal section of the needle 12, such needle 12 has a longitudinal groove 6 over a major portion of its central part and on its lower part, this groove 6 entirely going there through widthwise in this figure, but this is not compulsory.

This longitudinal groove 6 in its lower portion opens above the inner pipe 11 of the needle 10 and thus permits the flow of the product contained in the pipe 11 through the portion of the needle 12 wherein it extends. The longitudinal groove 6 sealingly communicates with said inner pipe 11.

In this way, the inner pipe 11 indirectly leads into the discharge chamber to allow the flow of the product through said chamber, since the groove 6 inside the needle 12 forms the passage for the flow of the product by being connected to the upper end of the inner pipe 11 and by opening into the discharge chamber.

Figure 3:
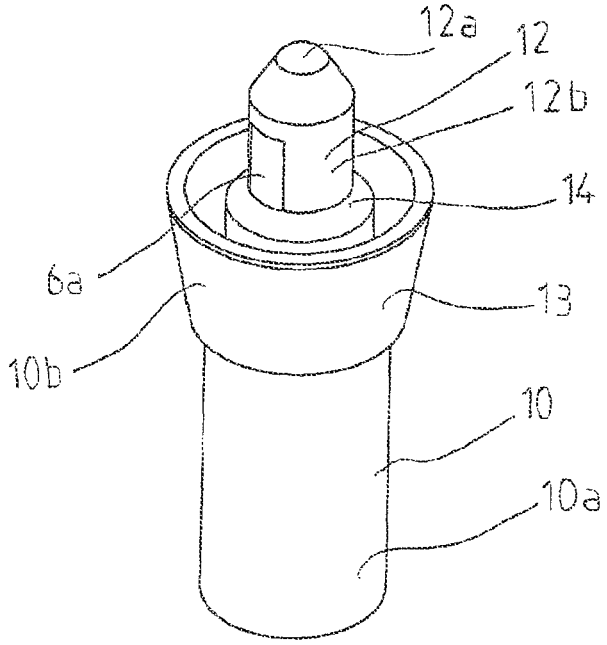
Figure 4:
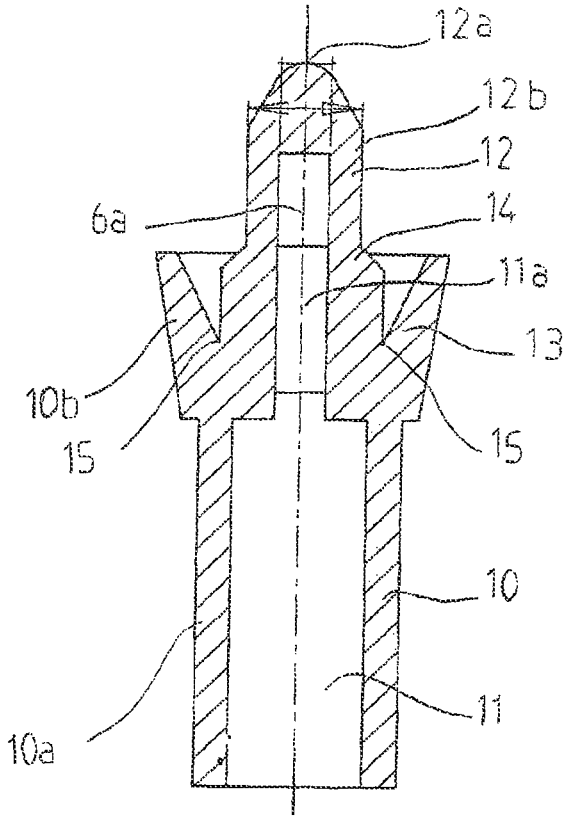
Figure 5:
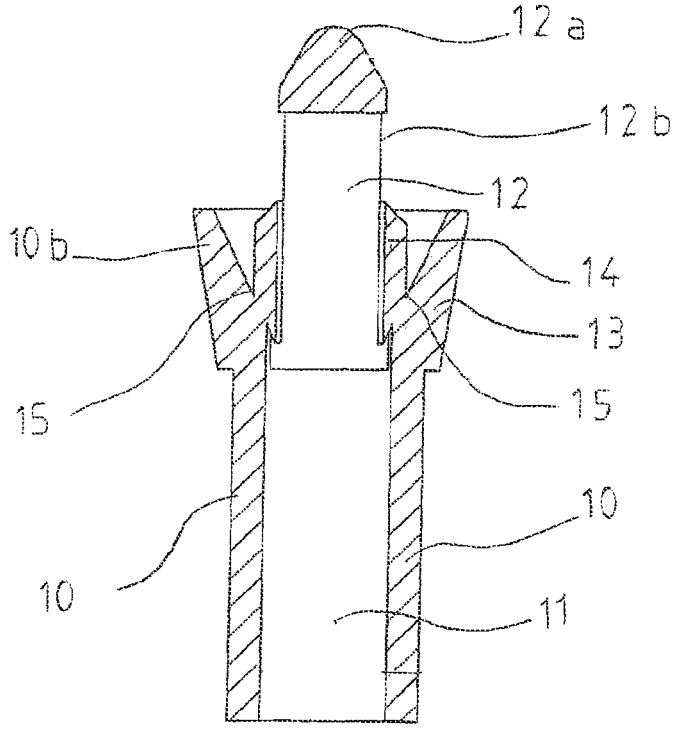

As shown in FIG. 3, the longitudinal groove, without reference number in this figure, partially goes out of the piston 10 when the needle 12 is positioned in and on the head 10*b* of the piston 10 to form the top thereof. This provides at least a slot 6*a* formed by a portion of said groove, the slot 6*a* acting as a filling opening to be used for the product to flow from the inner pipe in the discharge chamber, which was referenced 5 in FIG. 1. The discharge chamber is thus in communication with the container for the flowing, into this chamber, of the product to be metered and dispensed.

When the longitudinal groove goes through the needle 12 along its entire width, it advantageously creates two slots forming two diametrically opposite openings. Alternatively, it is also possible for the longitudinal groove to be so designed that a single slot 6*a* leads to one side of the needle 12 only.

Referring to FIGS. 2 to 5, the head 10*b* of the piston is composed of an outer flange 13 laterally projecting from the piston body 10*a*, while flaring upwards. The head 10*b* of the piston further comprises an inner flange 14 surrounding the lower part and at least partially the central part 12 of the needle. The piston head 10*b* is thus composed of the needle 12 and the flanges 13 and 14.

The outer flange 13 and the inner flange 14 define between them a space 15. This space 15 decreases as it gets closer to the body 10*a* of the piston 10. The space 15 is a part of the discharge chamber and is advantageously used as a reservoir for the product, when the latter is contained in the discharge chamber.

As shown in FIG. 1, the upper end 12*a* of the needle 12 is used as a closing member, and the upper end 12*a* may close the outlet opening 7 of the discharge chamber 5, thus preventing the product contained in the discharge chamber 5 from leaving the latter to be dispensed outside of the metering pump 1 and consequently the container 2.

FIG. 6 shows another embodiment of the arrangement of a metering and dispensing pump according to the present invention on a container of liquid or viscous product to be dispensed.

In this embodiment, the container cap 4*a* incorporates the metering and dispensing pump always to the top thereof, but perpendicular to a line 17 supplying the product contained in the reservoir, not shown in this figure. The pipe 17 leads into the inner pipe 11 of the pump 1. The pipe 17 and the inner pipe 11 then form an angle, in FIG. 6 a right angle, in the cap of the container 4*a*. The outlet opening 7 of the product is then positioned laterally with respect to the cap 4*a* and not above it, as was the case in FIG. 1.

Otherwise, the operation of the pump 1 is the same and the latter has the same constituents as those mentioned in the first embodiment shown in FIG. 1, especially with the presence of the needle 12 and its upper end 12*a* used as items closing the outlet opening 7 for the product.

It should be noted, however, in reference to an earlier part of the description, that the shape of the body 10*a* of the piston is modified in the case of FIG. 6.

This figure also shows an advantageous optional feature for checking the tightness of the assembly. More specifically, in this embodiment, a hole 22 is formed through the peripheral wall 24 defining the main chamber 9. The peripheral wall 24 is also in the case illustrated, embedded in a seat 23 for example integral with the rest of the cap 4, in order to maintain a passage of air between the outside and the orifice 22. Several orifices 22 may be provided. Their positions may also differ from the example shown.

Figure 7:
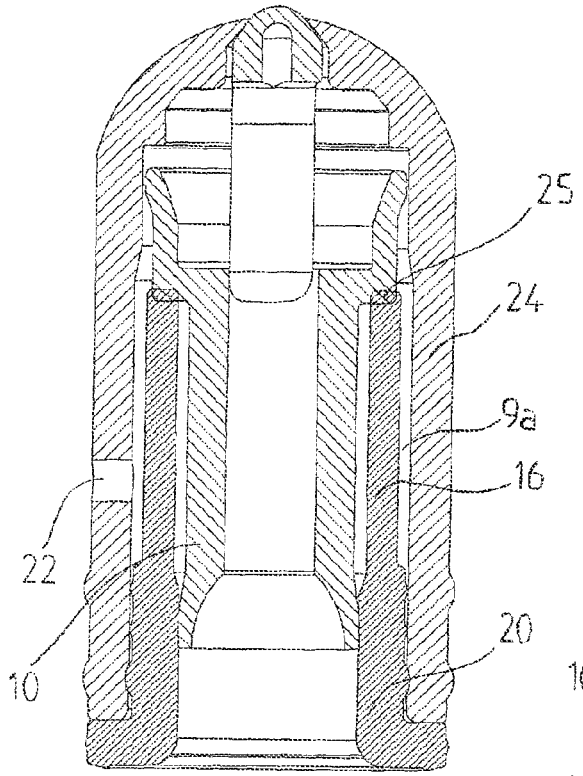
Figure 8:
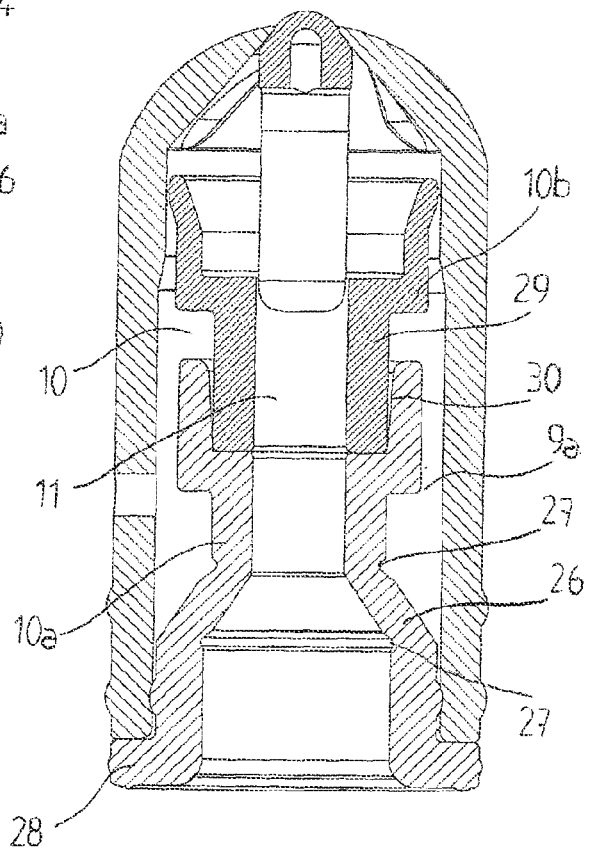
FIG. 8 shows an alternative implementation of the return means.
Figure 9:
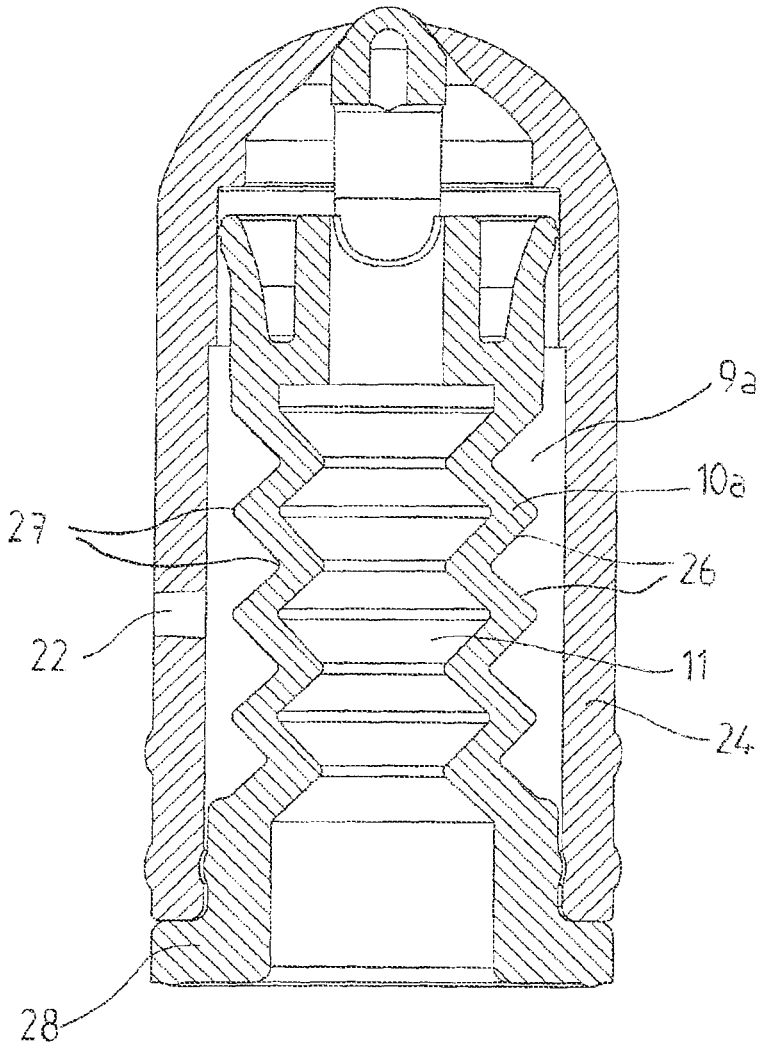
FIG. 9 shows an alternative embodiment of the return means.

FIGS. 7 to 9, described above, depict three alternative embodiments of the invention. Specifically, these figures illustrate alternative or complementary embodiments of the return means.

In the case of the example of FIG. 7, the return means 16 are, like those in the previous cases, accommodated in the volume of the chamber 9*a*. On the contrary, they are formed here as an element the material of which is elastically deformable. Elastomer is preferably used to form the return means 16, in this case. In the Figure, the return means 16 are a cylindrical element with a circular section, extending between the guide liner 20 against which the piston body 10 is slidably mounted and, at the other end, a support end 25 which applies to an application portion of the piston head. It should be understood that when the fluid exerts a pressure in the discharge chamber 5, the piston compresses the return means 16 as an elastically deformable material. This compression stores return energy that is used to release the system to ensure the return to the closed position of the needle 12. Other shapes are possible for the element made of an elastically deformable material.

FIG. 8 shows another possible alternative embodiment of the return means. In the latter case, they are made of or include at least one flexible wall 26. In the case shown, a single face 26 is formed and extends from a base portion of the piston 28 sealingly connected to the peripheral wall 24. A hinge 27 is the connecting point between the base 28 and the flexible wall 26. At its other end, the flexible wall also has a hinged area 27 relative to the rest of the body 10*a* of the piston 10. Advantageously, the flexible wall 26 has a geometric shape such that it comprises a component which is not directed in the longitudinal direction of the assembly (the direction of translation of the piston 10). Thus, during a translational movement of the piston 10, the face 26 undergoes a stress which is not a compression and in particular a bending which may be used as a resilient return member.

To facilitate the bending deformation of the face 26, the hinges 27 may have a narrowing part i.e. vary in thickness relative to the thickness of the face 26. This embodiment of the invention is suggested in FIG. 8. This figure also shows an alternative embodiment of the piston 10 in which the body 10*a* and the head 10*b* are made of two distinct parts. These parts are assembled by a male/female fitting system. In the illustrated case, the body 10*a* comprises a sleeve 30 of the female type adapted to receive the lower end of the piston head 10*b*. Other configurations are, of course, possible. The pipe 11 in the piston 10 is thus partly formed in the body part

10*a* and, for another part in the head part 10*b*. The portions of the pipe 11 of these two parts are configured to form a continuity and are advantageously of the same shape and the same diameter.

It should be understood that this particular embodiment allows to differentiate the materials used for the body 10*a* and head 10*b* or replace a defective part without replacing the other one.

FIG. 9 shows another possible alternative embodiment of the return means, as in the previous case, it takes advantage of the bending of the face 26. In this case, a plurality of faces 26 are implemented and, in particular, made adjacent so as to form bellows. The faces 26 are joined here and have alternating directions around hinges 27. As in the previous case, it is advantageous to implement faces which are parts of the body length 10*a* having a tapered section. The number of faces 26 is not limited and it should be noted that in the case shown in FIG. 9, eight faces having alternating directions have been embodied so as to form the bellows.

Return means accommodated in the separation chamber 9*a* and return means in the form of flexible walls as described above may be combined. Two return means may thus be combined so as to obtain a better return in position and/or avoid fatigue of the elastic means.

It should be noted that in the embodiments of FIGS. 8 and 9, the piston 10 is directly secured to the base at the peripheral wall 24, so that its lower end does not translate relative to a guide liner 20 as in the preceding embodiments. This eliminates the need for mobility and tightness.

These embodiments also limit the static indeterminacy of the system and make it possible, thanks to the flexible wall, to provide a self-adjustment of the piston during its translation so as to optimally position the needle 12. Self-centering is thus achieved.

For example, at least in the embodiments of FIGS. 8 and 9, a body 10*a* of piston 10 made of polypropylene and/or advantageously, as in the case of elastic return means 16 of FIG. 7, made of elastomer such as EVA (ethylene vinyl acetate) or SEBS (polystyrene-b-poly (ethylene-butylene)-b-polystyrene) may be implemented.

In a test phase, one aspect of the invention is to implement a method for testing the sealing at the piston 10. To this end, a gas under a defined pressure is injected through the orifice 22. Loss-of-vacuum may also be detected in case of pressure drop. Test can advantageously be carried out without damaging the pump and without removing its components. It can therefore be repeated on many parts produced or even be systematic. In this embodiment, the separation chamber 9*a* therefore also acts as a leak test volume. The orifice(s) 22 may be plugged again after the test.

In an alternative or additional possibility, the method of the invention may be such that the orifice 22 is used for positioning a leak detector. In this configuration, other parts of the pump are pressurized and any leakage is detected at the orifice 22. In a preferred embodiment, the test starts by supplying a test fluid via the inlet opening 18 of the pump and the absence of leakage is checked at the orifice 22. Then, a test fluid is fed via the outlet opening and verification is performed on whether leakage is detected at the orifice 22.

The initial checking may then be resumed by feeding the test fluid through the inlet opening 18.

In any case, common detection means, more particularly a fluid pressure sensor may be used. The fluid used may be air or any other fluid compatible with the application.

Referring to all the figures in combination and taking as an example a pump 1 with a needle 12 as described above, which is not limiting to the present invention, the pump 1 can operate as follows.

A pressure is exerted on one element of the container 2 containing the product to be dispensed. This may, for example, be done on the wall of the container body 2 even when it is made of flexible or deformable material, in particular when the container is made of plastic material and preferably when it has the shape of a tube, by one or more manual pressure(s).

This may also be done through a small volume bulb which is placed away from the advantageously deformable container body and is connected thereto by a flexible pipe, the bulb is not shown in the Figures.

In both cases, the pressure(s) exerted respectively on the container body 2 or the bulb, push(es) an amount of product into the inner pipe 11 of the body 10*a* of the piston. Part of this amount of product will be sent to the discharge chamber 5 through the inside of the needle 12, for example through the centerline longitudinal groove 6 of said needle 12.

It should be kept in mind that all these operations take place without the product entering the separation chamber 9*a* which is sealed and isolated from the flow of the product, thus protecting the return means 16 accommodated therein.

As product is introduced into the discharge chamber 5, due to the pressure exerted by the amount of product in the pump 1, the discharge chamber 5 expands and the volume thereof increases, which lowers the piston head 10*b* to the lower part of the pump 1 and lowers the needle 12 with the entire head 10*b*. This occurs against the force exerted by the return means 16 accommodated in the sealed separation chamber 9*a* and/or formed by the flexible walls.

Because of this downward movement of the piston head 10*b*, the upper end 12*a* of the needle 12 used as a closing member of the outlet opening 7 of the pump, is released from its closed position of this outlet opening 7 and no longer closes off the latter. The product can then exit the discharge chamber 5 to be dispensed outside, preferably by spraying, in particular for liquids.

When the thrust exerted by the amount of product in the pump 1 decreases, due to the discharge thereof from the pump 1, and falls below the reaction force of the return means 16, the piston head 10*b* is returned to its upper position by the return means 16 and the upper end 12*a* of the needle 12 closes the opening.

The advantages of using a needle to close the outlet opening of the pump are among others that the needle may advantageously be designed as a separate part of the flanges forming therewith the piston head. Indeed, as the needle and especially its upper end is the part of the piston head receiving the largest amount of stress, when it is pushed against the outlet of the pump by the action of the return means, the needle is more liable to wear than the other parts forming the piston head. With a removable needle, it is possible to make the change without having to change the entire piston head and even the whole piston head if the head is integral with the piston body.

The invention is not limited to the embodiments described but applies to any embodiment complying with the spirit thereof.

REFERENCES

1. metering pump
2. container
3. dispensing member

4. cap
4*a*. cap
5. discharge chamber
6. groove
6*a*. slot
7. outlet opening
8. thread
9. main chamber
9*a*. separation chamber
10. piston
10*a*. piston body
10*b*. piston head
11. inner pipe
12. needle
12*a*. upper end of the needle
12*b*. needle rod
13. outer flange
14. inner flange
15. space
16. return means
17. pipe
18. inlet opening
20. guide liner
21. base
22. orifice
23. seat
24. peripheral wall
25. resting end
26. flexible wall
27. hinge
28. piston base
29. piston head
30. sleeve

The invention claimed is:

1. A device for metering and dispensing a liquid or viscous product intended to be associated with a container containing said product, with said device having, at one lower longitudinal end, an inlet opening for the passage of the product from the container and at an upper longitudinal end, an outlet opening for the dispensing of the product, with said device having inside a main chamber accommodating a piston having a body and a head, with said piston being movable lengthwise with respect to the main chamber, said body having an inner pipe extending lengthwise therethrough, a lower part of the inner pipe being connected to the inlet opening for the product to flow from said opening inlet, said body and the lower part of said piston head occupying the main chamber leaving only a separation chamber empty, positioned about the piston body, with said piston head totally separating the separation chamber from a discharge chamber positioned near the outlet opening, with the upper part of said head having in the upper middle portion thereof a closing element for said outlet opening, the inner pipe at its upper end indirectly leading into the discharge chamber for the product to flow into said chamber, said discharge chamber having a variable volume according to the piston motion within the main chamber, a return element being provided to act on the piston by placing the closing element in the position closing said outlet opening, wherein the separation chamber is sealed with respect to the product flow since the separation chamber is not passed through by the product flow, wherein the closing element is the upper end of a needle extending between the upper end of the inner pipe and the outlet opening of the device, and wherein the needle has a rod and an upper end having a rounded or an acute shape, and wherein a portion of the rod is surrounded by an inner flange, with the remaining portion of the rod and the rounded or acute shaped upper end of the needle projecting upwards from said inner flange, with said inner flange being surrounded by an outer flange while leaving a space there between, the needle and said flanges forming the piston head.

2. The pump-device according to claim 1, wherein the main chamber is at least partially delimited by a peripheral wall having at least one orifice leading, on the one hand, into the main chamber and on the other hand, to the outside of the device.

3. The device according to claim 1, wherein the space between said flanges decreases towards the body of the piston.

4. The device according to claim 1, wherein the needle has a passage for the product from the inner pipe while being connected at its lower part to said inner pipe and at least one filling opening leading into the discharge chamber for said product to flow into the discharge chamber.

5. The device according to claim 4, wherein the passage is provided by a longitudinal groove extending from the lower part of the needle opposite the inner pipe and in sealing communication with said inner pipe, with at least a portion of the groove forming a slot on the periphery of the needle, with such slot being used as a filling opening.

6. The device according to claim 5, wherein the groove extends over the entire width of the needle, with two portions of the groove each forming a slot on the periphery of the needle, with said slots being oppositely positioned on said periphery.

7. The device according to claim 1, wherein the return element is at least partly accommodated in the separation chamber.

8. The device according to claim 7, wherein the return element comprises a helical spring or at least a flexible blade surrounding the body of the piston on at least part of the length thereof.

9. The device according to claim 7, wherein the return element comprises an element made of an elastically deformable material.

10. The device according to claim 9, wherein the element made of an elastically deformable material is a hollow cylindrical body surrounding the body of the piston.

11. The device according to claim 7, wherein the return element is integrally accommodated in the separation chamber.

12. The device according to claim 1, wherein the return element comprises at least one flexible wall formed on the body.

13. The device according to claim 12, wherein the at least one flexible wall is a portion of the body having a tapered shape.

14. The device according to claim 12, wherein the at least one flexible wall is connected to the body by hinged areas.

15. The device according to claim 14, wherein the hinged areas have a relatively reduced thickness as compared with that of the flexible wall.

16. The device according to claim 12 comprising a plurality of flexible walls.

17. The device according to claim 16, wherein at least two flexible walls are so configured as to form bellows.

18. The device according to claim 1, wherein the body and the head are two separate fit parts.

19. The device according to claim 1, wherein the outlet opening of the device is in line with its inlet opening or forms an angle therewith.

20. The device according to claim 1, wherein the body of the piston comprises a base toward its free end opposite the head, with the base cooperating with a liner guide through a tight slide fit.

21. The device according to claim 20, wherein the base has an outer profile which widens towards the free end of the body.

22. The device according to claim 21, wherein the outer profile is domed so as to be convex.

23. The device according to claim 20, wherein the base has an inner profile which widens towards the free end of the body.

24. The device according to claim 23, wherein the thickness of the base decreases towards the free end of the body.

25. The device according to claim 23, wherein the inner profile is curved so as to be concave.

26. A detachable cap intended to be associated with a container containing a liquid or viscous product, and integrating a metering and dispensing device according to claim 1.

* * * * *